United States Patent [19]

Rudolf et al.

[11] Patent Number: 4,989,374

[45] Date of Patent: Feb. 5, 1991

[54] PORTABLE MACHINE TOOL WITH AUTOMATIC LOCKING OF THE WORK SPINDLE

[75] Inventors: Boris Rudolf; Walter Blutharsch, both of Stuttgart, Fed. Rep. of Germany

[73] Assignee: C. & E. Fein GmbH & Co., Stuttgart, Fed. Rep. of Germany

[21] Appl. No.: 275,497

[22] Filed: Nov. 23, 1988

[30] Foreign Application Priority Data

Dec. 8, 1987 [DE] Fed. Rep. of Germany ..... 3741484

[51] Int. Cl.[5] ..... B24B 41/04; B24B 45/00; B24B 23/02; B26D 1/12

[52] U.S. Cl. ..... 51/168; 51/170 R; 83/666

[58] Field of Search ..... 51/168, 109 R, 134.5, 51/132, 209 R; 83/666

[56] References Cited

U.S. PATENT DOCUMENTS

| | | | |
|---|---|---|---|
| 3,945,694 | 3/1976 | Vaillette | 51/168 X |
| 4,434,586 | 3/1984 | Müller | 51/168 X |
| 4,597,227 | 7/1986 | Gentischer | 51/168 |
| 4,901,479 | 2/1990 | Helm | 51/168 X |

FOREIGN PATENT DOCUMENTS

| | | |
|---|---|---|
| 0152564 | 1/1987 | European Pat. Off. . |
| 0235598 | 10/1987 | European Pat. Off. . |
| 1623791 | 5/1951 | Fed. Rep. of Germany . |
| 3603384 | 8/1987 | Fed. Rep. of Germany . |

*Primary Examiner*—Frederick R. Schmidt
*Assistant Examiner*—Bruce P. Watson
*Attorney, Agent, or Firm*—Kramer, Brufsky & Cifelli

[57] ABSTRACT

In order to so improve a portable machine tool, in particular, an angle grinder, with a drive, with a work spindle having a tool clamping means and with a securing device which is operable from outside an apparatus housing and by means of which the tool clamping means is transferable from a manually releasable position to a manually unreleasable position in which the tool is clamped—and vice versa—that with a design which is as simple as possible from a structural point of view, rotation of the work spindle is not possible while the tool clamping means is being released or manually tightened, it is proposed that a locking device for non-rotatably fixing the work spindle on the apparatus housing be provided and that the locking device automatically lock the work spindle in a non-rotatable manner when the drive is switched off and the securing device is in the position in which the tool clamping means is manually releasable—and vice versa.

13 Claims, 6 Drawing Sheets

Figure 1:
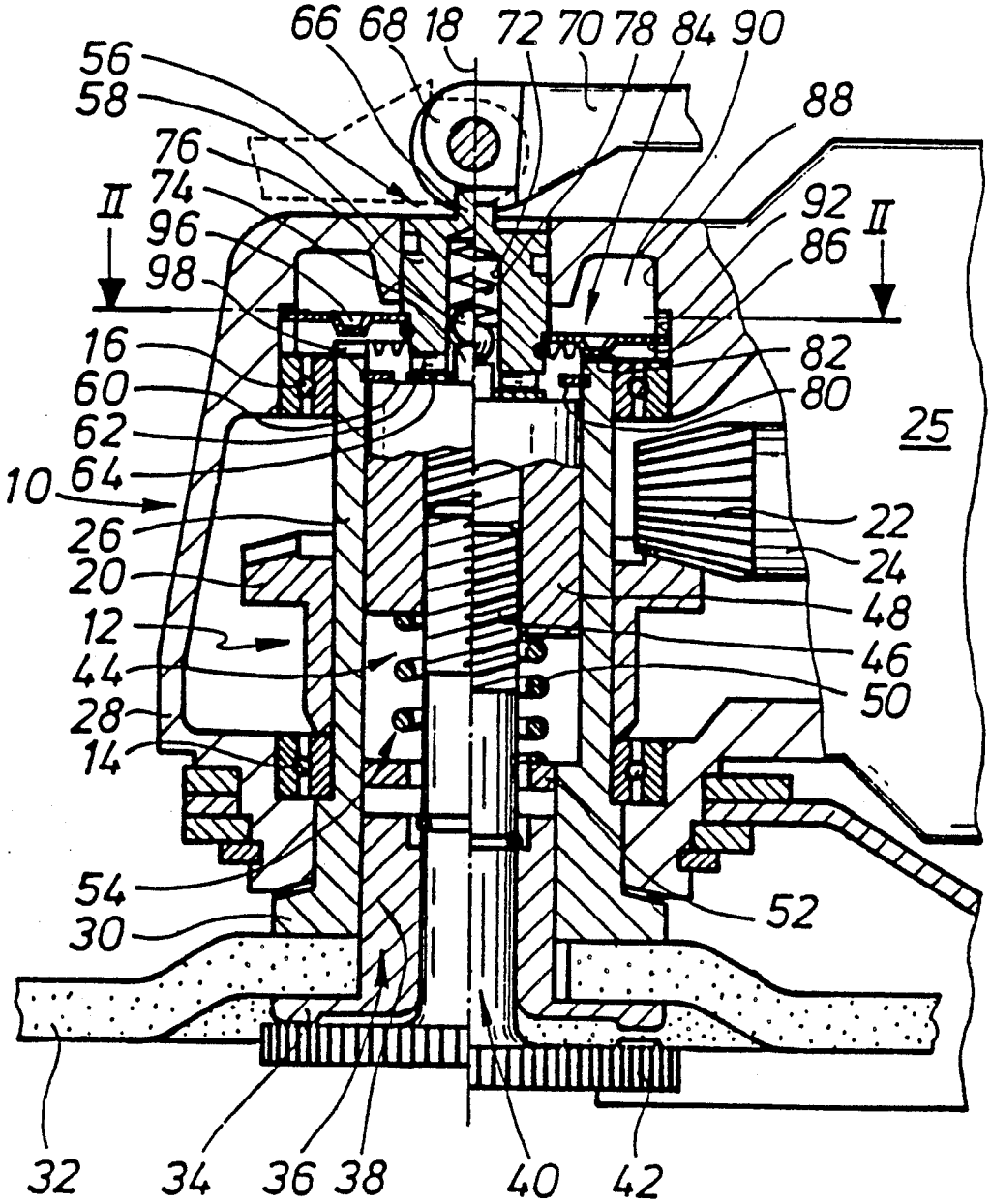

Fig.9
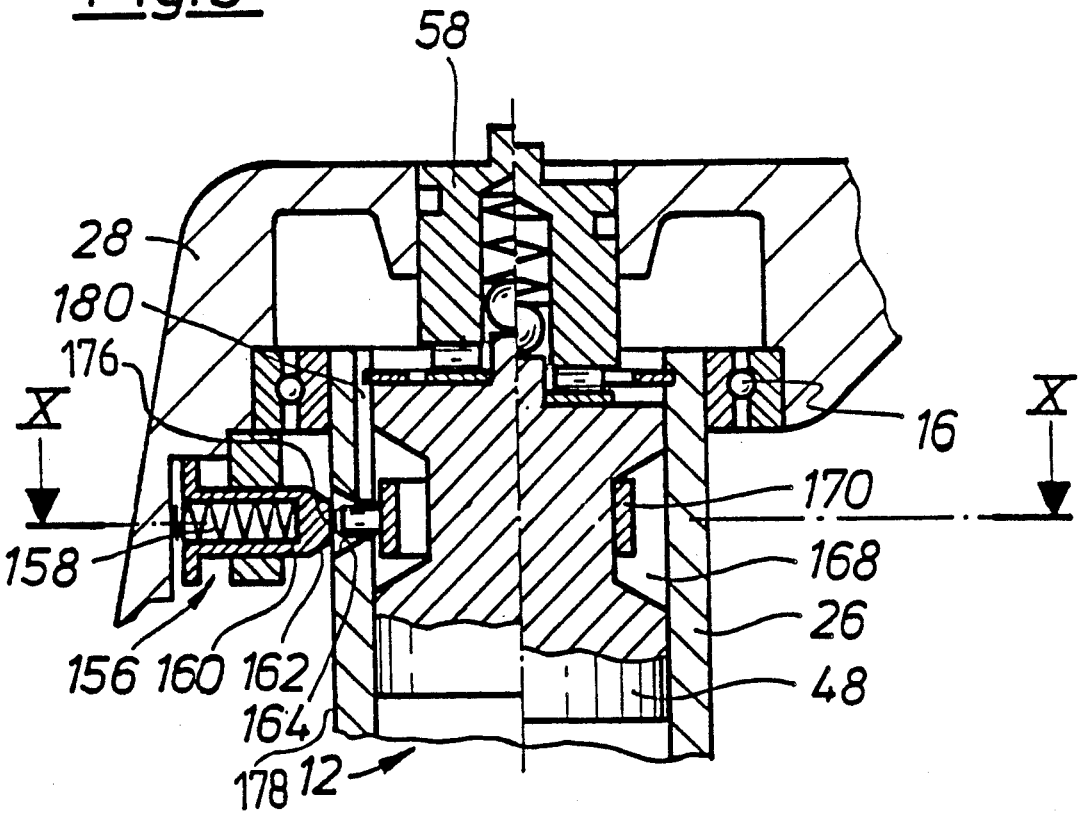
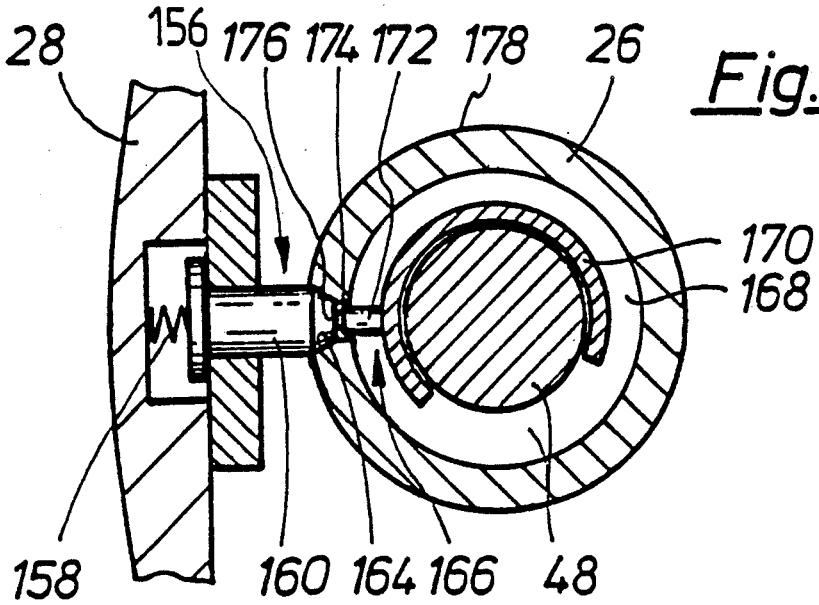
Fig.10

PORTABLE MACHINE TOOL WITH AUTOMATIC LOCKING OF THE WORK SPINDLE

The invention relates to a portable machine tool, in particular, an angle grinder, with a drive, with a work spindle having a tool claimping means, in particular, for disc-shaped tools and with a securing device which is operable from outside an apparatus housing and by means of which the tool clamping means is transferable from a manually releasable position to a manually unreleasable position in which the tool is clamped—and vice versa.

Such portable machine tools are known, for example, from EP-A 0152564 and from German Patent Application P 36 23 555.5-14.

Herein, the tool, i.e. the grinding tool is exchangeable without any auxiliary tool for when a grinding disc is inserted, the tool clamping means has only to be turned by hand and secured by the securing device and the grinding disc thereby fully clamped. Similarly, for removal of the grinding disc, the tool clamping means is releasable by the securing device to the extent that the tool clamping means can be loosened by hand.

With such portable machine tools, attention must be paid to the fact that before the tool clamping means is fixed by the securing device, the work spindle can rotate freely while the tool clamping means is being tightened and released and so tightening of the tool clamping means by hand may also present difficulties.

The object underlying the invention is, therefore, to so improve a portable machine tool of the generic kind that with a design which is as simple as possible from the structural point of view, rotation of the work spindle is not possible when the tool clamping means is being released or manually tightened.

This object is accomplished in accordance with the invention in a portable machine tool of the kind described at the beginning by a locking device for non-rotatably fixing the work spindle on the apparatus housing being provided and by the locking device automatically locking the work spindle in a non-rotatable manner when the drive is switched off and the securing device is in the position in which the tool clamping means is manually releasable—and vice versa.

Such a locking device is known from German Utility Model 1 623 791 but it is operable from outside the housing and requires an additional actuating operation, more particularly, one hand of an operator is fully occupied with actuating this locking device during exchange of the grinding disc. A further disadvantage of the locking device of German Utility Model 1 623 791 is that an additional opening is required in the gear housing, which increases the danger of leakage in the latter.

By means of the invention solution, firstly, the work spindle as such is lockable and, secondly it is additionally ensured that when the drive is switched off and, in particular, at a standstill, and the securing device is in the position in which the tool clamping means is manually releasable, this locking takes place automatically. This results in substantially simpler operation and, in particular, in avoidance of a further opening in the housing, an advantage which is clearly apparent in the gear housings of electric tools which always prove difficult to seal.

Regarding the design of the work spindle in the portable machine tools or angle grinders according to the invention, it has proven advantageous for the work spindle to be in the form of a hollow shaft. Also, the tool clamping means is preferably of such design that it comprises a counter flange held on the hollow shaft and a manually operable clamping flange. Furthermore, the tool clamping means is advantageously transferable by axial displacement of the clamping flange from the manually releasable position to the unreleasable position in which the tool is clamped.

In these embodiments, it is particularly preferred for the securing device to comprise a clamping device arranged in the hollow shaft and a shifting device which acts upon the clamping device. Expediently, the shifting device is actuatable by an actuating member which is provided in the housing.

In a further development of the inventive solution, the locking device comprises two coupling elements which can be brought into operative engagement with each other by actuation of the locking device and which can be released from operative engagement with each other out of this position against the force of an elastic element. This has the advantage that when the locking device is actuated the elastic element will endeavor to bring the coupling elements into operative engagement or to keep them in operative engagement, which is of importance particularly in the case of coupling elements which are connectable by positive engagement and which cannot be made to engage in every relative position.

One possible solution is for the locking device to comprise coupling elements which form a friction coupling.

Another possible solution for the locking device is for one coupling element to comprise at least one claw and the respective other coupling element to comprise a counterpart which can be made to engage with the claw. It is, however, also conceivable for the coupling elements to be designed as a friction coupling and to additionally comprise a claw and a counterpart which is engageable therewith.

The use of claws entails the problem that an operator may inadvertently—while the claw is in engagement with the counterpart—switch on the electric drive. In this case, there is the danger of the locking device or the driving device undergoing damage. For this reason, the claw and/or the counterpart comprise in their regions which come to rest against one another and which extend transversely to a direction of rotation, abutting surfaces which are oriented at an incline to the direction of rotation so that when the coupling is engaged, the claw and the counterpart can be held in engagement by being acted upon by the elastic element, but can be disengaged by sliding on the abutting surfaces against the force of the elastic element.

In one embodiment of the above-described locking device, the claw and the counterpart can be brought into engagement with each other by an adjusting motion in the axial direction in relation to the work spindle.

In an alternative solution, it is, however, similarly conceivable for the claw and the counterpart to be advanceable towards each other by an adjusting motion in the radial direction in relation to the work spindle.

In order to obtain a construction which saves as much space as possible, it is expedient, particularly when the electric tool is an angle grinder, for the locking device to be arranged at an end of the work spindle which is located opposite the tool clamping means.

In the embodiments described so far, it has not been specified in which way the automatic actuation of the locking device is to take place in order for it to non-rotatably lock the work spindle when the drive is switched off and the securing device is in the position in which the tool clamping means is manually releasable. In a preferred variant, it is conceivable for the locking device to be actuatable by operating the securing device. This automatically ensures that the locking device is also actuated when the electric drive is switched off because actuation of the securing device itself is only possible when the work spindle is at a standstill.

In this inventive solution, actuation of the locking device could, in principle, be carried out both by the axial movement of the clamping device and by the axial movement of the shifting device or the actuating member of the shifting device. However, a solution in which the locking device is actuatable by the shifting device has proven particularly simple and expedient from a structural point of view.

In such a solution which, above all, is extremely simple from a structural point of view, the shifting device comprises a first coupling element displaceable in the axial direction of the work spindle towards the latter and non-rotatably held in the housing and the work spindle comprises a second coupling element and these coupling elements can be brought into engagement with each other at those sides thereof which face one another.

More particularly, provision is made in this solution for the first coupling element to be held on an intermediate part of the shifting device.

To enable the coupling elements to disengage from one another if the drive is inadvertently switched on, provision is made in this variable for at least one of the coupling elements to be elastically connected to the shifting device or to the work spindle in the axial direction.

A construction in which one of the coupling elements is arranged on an elastic carrier is particularly simple. In this embodiment, the elasticity can be further improved by slots being provided on a coupling element made of such elastic material on opposite sides of the claw—or of its counterpart—to obtain a region between these slots which carries the claw or the counterpart and has additional resilience in comparison with the remainder of the coupling element.

As an alternative or supplement to the above-described variant according to which the locking device is actuatable by the shifting device, provision is made in a further preferred variant for the locking device to be actuatable by switching off the drive and to be releasable by switching on the latter.

To this end, it is expedient for the locking device to be able to be held in the released position by a centrifugal adjusting mechanism so that the locking device cannot become operative when the work spindle is rotating.

In a structural implementation of such a solution, provision is made for the centrifugal adjusting mechanism to comprise a centrifugal body which is movable radially in relation to the work spindle and by means of which the coupling elements can be disengaged.

The locking device is then preferably of such design that one coupling element is a bolt which is fixedly arranged on the housing and movable radially towards the work spindle and has a claw at its end face and that the counterpart is a recess in an outer surface of the work spindle.

In a further development of this device, the centrifugal adjusting mechanism is preferably designed so as to comprise a centrifugal body which is mounted in the work spindle. When the work spindle rotates, the centrifugal body penetrates the recess from the interior of the work spindle and lies with a front surface in the same geometrical plane as the outer circumferential surface of the work spindle in order to prevent engagement of the claw.

In order to ensure that the centrifugal body releases the recess for engagement by the claw when the work spindle is at a standstill, this centrifugal body is additionally pretensioned by a spring element in the radial inward direction.

In addition or as an alternative to the centrifugal adjusting mechanism, it is conceivable in a further advantageous embodiment for the locking device to be transferable to a released position which no longer fixes the work spindle by an electric adjusting device which is connected in parallel with the drive and operates with the same power supply as the latter.

In the case of an electric drive, it is simplest for the adjusting device to be a magnet which draws the bolt outwards in the radial direction in relation to the work spindle and hence disengages it from the recess once the electric drive is switched on. In the case of a pneumatic drive, the adjusting device is a small pneumatic cylinder.

In a further development of this embodiment, it is, however, also conceivable to provide an additional electric circuit by means of which the electromagnet is activated and in accordance with the respective operating mode disengages the bolt from the recess.

Figure 2:
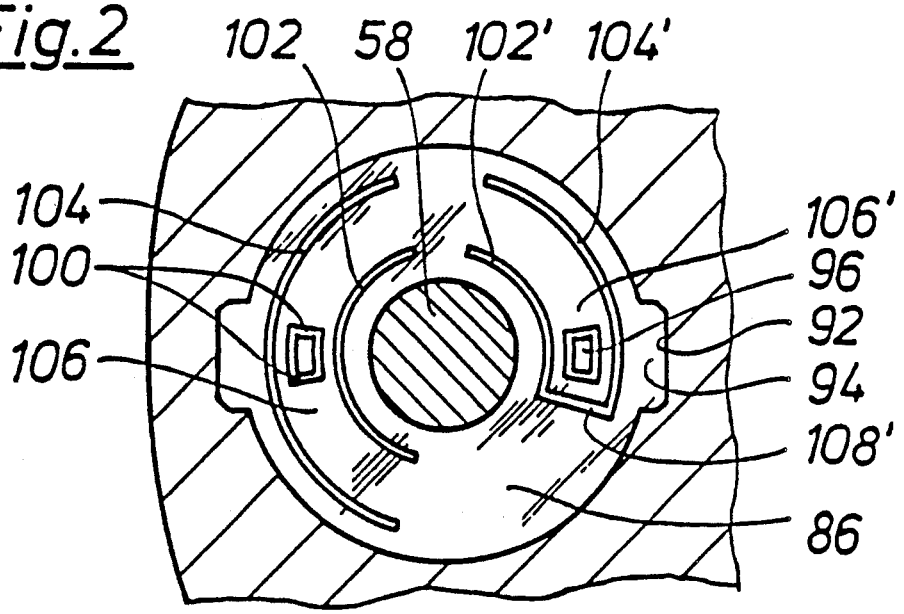
Figure 3:
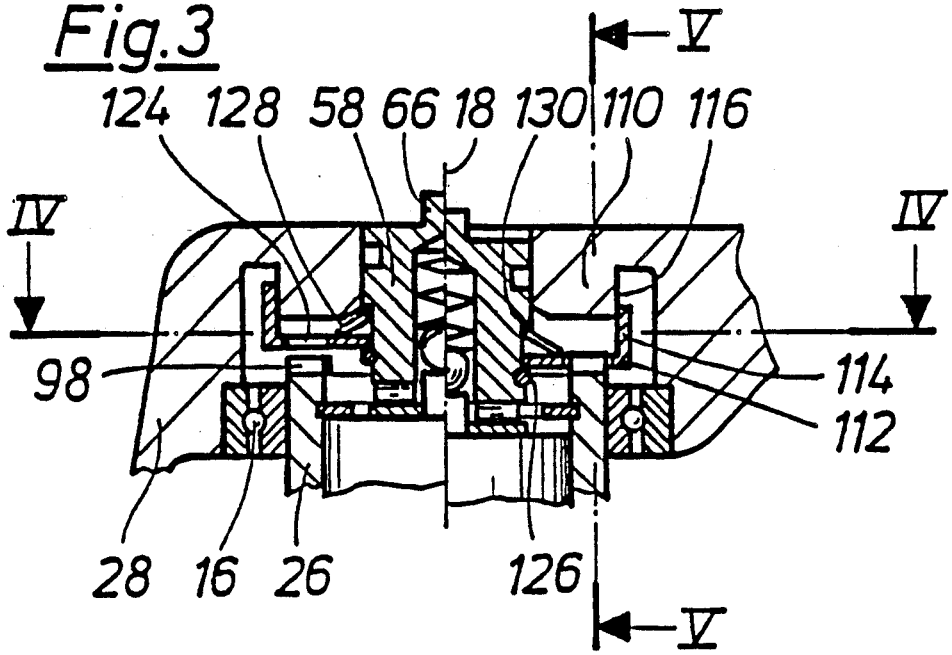
Figure 4:
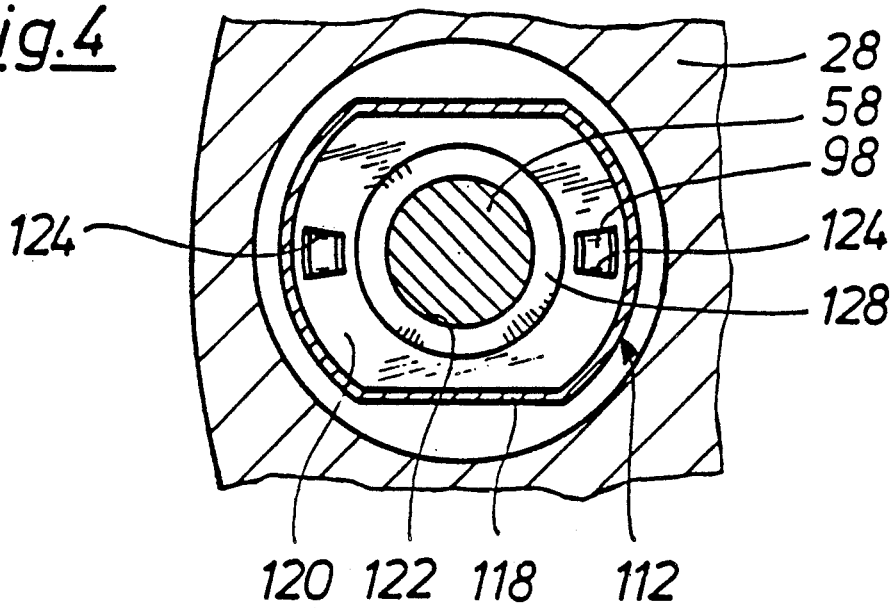
Figure 5:
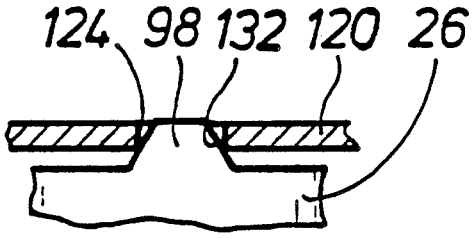
Figure 8:
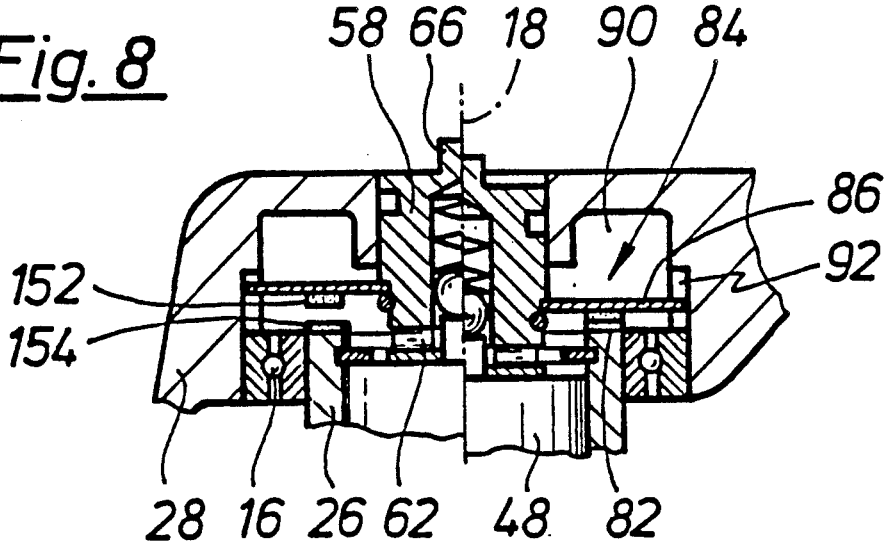
Figure 6:
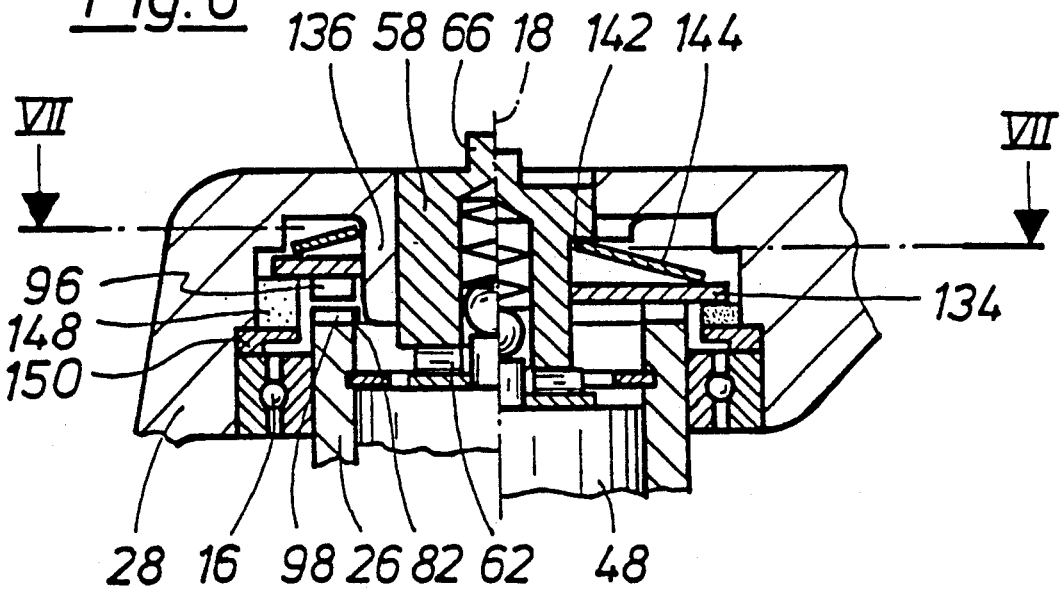
Figure 7:
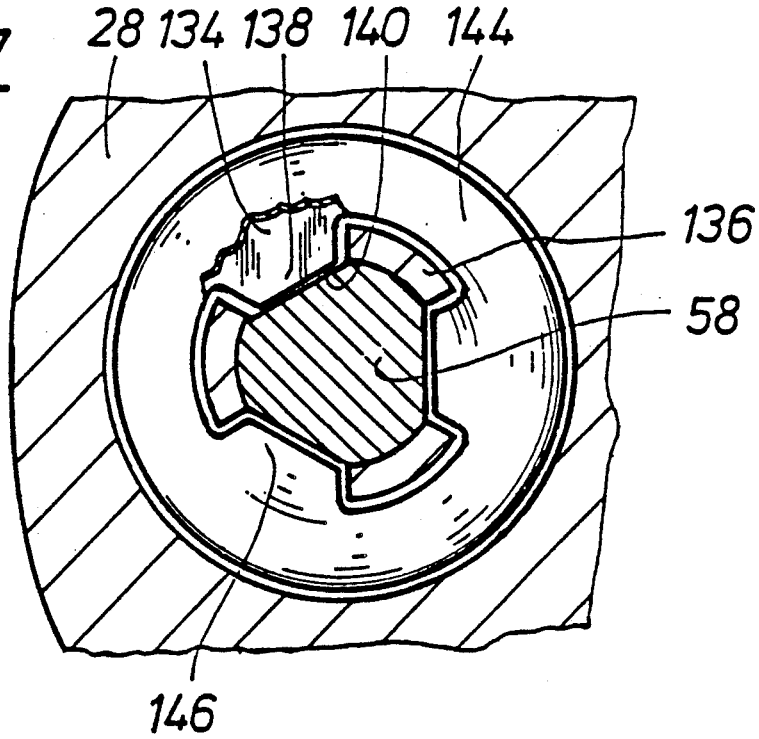
Figure 11:
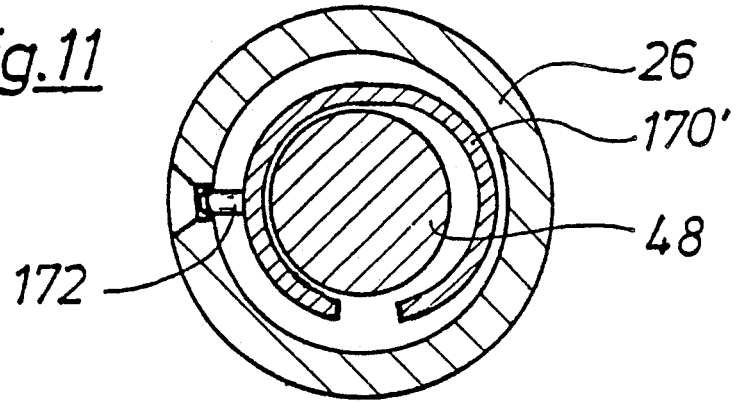

Further advantages and features of the invention are the subject of the following description and the appended drawings of several embodiments. The drawings show:

FIG. 1 a section through a gear head of a first embodiment of an angle grinder with a securing device for a tool clamping means, wherein in the right-hand half the securing device and the tool clamping means are illustrated in their manually releasable position and in the left-hand half the securing device and the tool clamping means are illustrated in their unreleasable position in which the tool is clamped;

FIG. 2 a section along line II—II in FIG. 1;

FIG. 3 a section through a second embodiment similar to FIG. 1;

FIG. 4 a section along line IV—IV in FIG. 3;

FIG. 5 a section along line V—V in FIG. 3;

FIG. 6 a section through a third embodiment similar to FIG. 1;

FIG. 7 a section along line VII—VII in FIG. 6;

FIG. 8 a section through a fourth embodiment similar to FIG. 1;

FIG. 9 a section through a fifth embodiment similar to FIG. 1;

FIG. 10 a section along line X—X in FIG. 9;

FIG. 11 a section similar to FIG. 10 through a variant; and

Figure 12:
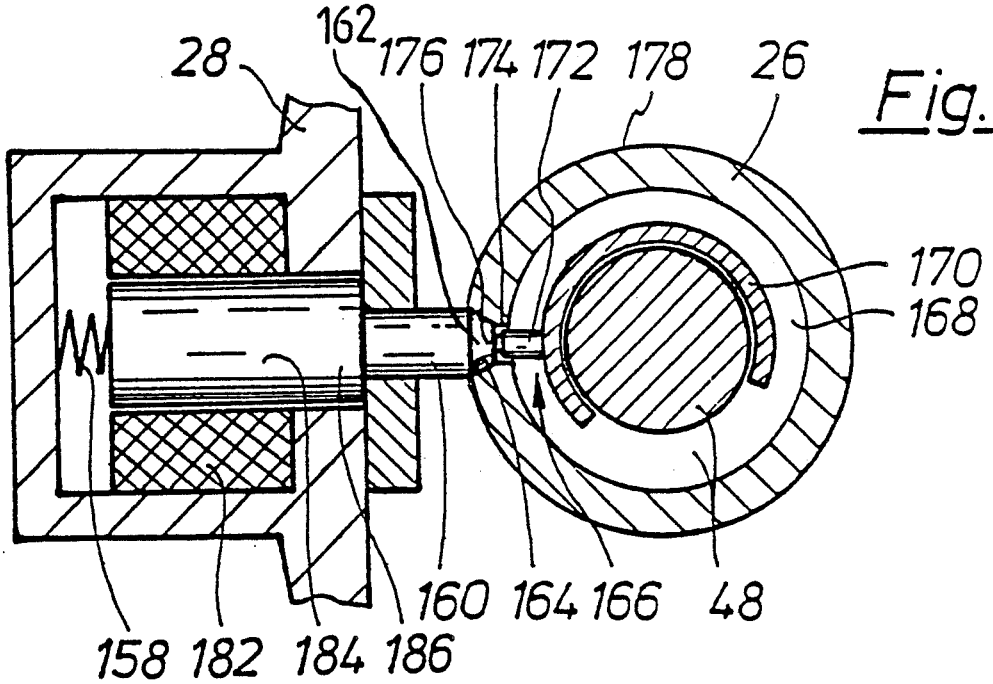

FIG. 12 a section through a sixth embodiment similar to FIG. 10.

A gear head, designated in its entirety 10, of a first embodiment of an inventive angle grinder is shown in FIG. 1. In this gear head 10, a work spindle designated in its entirety 12 is mounted for rotation about an axis of rotation 18 in two bearings 14 and 16 which are arranged in spaced relation to each other. The work spindle 12 is driven through a first bevel gear 20 non-rotatably positioned on the work spindle 12 approximately at the center thereof and through a second bevel gear 22 which meshes with the first bevel gear 20. The second bevel gear is positioned on a drive shaft 24 of a drive 25 with a motor and the drive shaft 24 extends perpendicularly to the axis of rotation.

The work spindle 12 comprises a hollow shaft 26 which carries a counter flange 30 at its end protruding beyond a housing 28 of the gear head 10. In its central clamping region, a grinding disc 32 engages the counter flange 30. The grinding disc 32 is made to engage the counter flange 30 by a clamping flange 34 of an intermediate sleeve 36 which is insertable with its cylindrical extension 38 into the hollow shaft 26 from the counter flange 30 end and is held in a non-rotatable manner preferably by splines.

The intermediate sleeve 36 is acted upon as a whole by a screw 40 in the direction of the counter flange, and the screw 40 acts directly on the clamping flange 34 with its head 42 which overlaps the clamping flange 34. The grinding disc 32 is, therefore, clamped between the clamping flange 34 and the counter flange 30.

The screw 40 is part of a securing device designated in its entirety 44 and engages with its threaded section 46 a tension member 48 which is mounted in the work spindle 12 for sliding displacement in the axial direction in relation thereto. The tension member 48 is supported at its end facing the counter flange 30 on a spring 50 which, in turn, rests on a toroidal member 52 which is fixedly arranged in the hollow shaft 26 and is penetrated by the screw 40. Hence the spring 50 acts upon the tension member 48 in the direction away from the counter flange 30 and thereby clamps the grinding disc 32 between the clamping flange 34 and the flange 30 as shown on the left-hand side in FIG. 1.

A shifting device designated in its entirety 56 and arranged on a side of the work spindle 12 opposite the counter flange 30 is provided for actuation of this clamping device 54 of the securing device 44 comprising the tension member 48 and the spring 50 and also the screw 40. This shifting device 56 comprises an intermediate part 58 which acts upon an end face 60 facing away from the screw 40 through a roller bearing 62 and a slide disc 64. This intermediate part 58 is non-rotatably and axially displaceably arranged in the housing 28 on the side of the work spindle 12 opposite the screw 40 and extends through the housing 28 with a cam 66 which is displaceable parallel to the axis of rotation 18 in the direction towards the counter flange 30 by an eccentric 68 which is rotatably mounted on the housing 28. The eccentric 68 is preferably rotatable by means of an actuating lever 70.

In order that the intermediate part 58 acts upon the end face 60 of the tension member 48 with as small a force as possible when the clamping device 54 is in the state in which the grinding disc 32 is clamped, the intermediate part 58 is arranged coaxially with the axis of rotation 18 and is provided with a bore 72 which is likewise coaxial with the axis of rotation 18 and into which a centering pin 74 arranged on the end face 60 of the tension member 48 protrudes. Arranged on this centering pin 74 is a ball 76 which is acted upon at its end opposite the centering pin 74 by a spring 78 supported at a bottom of the bore 72. When the cam 66 is not acted upon by the eccentric 68, the intermediate part 58 is urged away from the tension member 48 by this spring 78 so the roller bearing 62 is not held under pressure by the intermediate part 58. This position is illustrated on the left-hand side in FIG. 1.

A securing ring 80 which is preferably arranged at a short distance from an end face 82 of the hollow shaft 26 opposite the counter flange 30 is provided in the hollow shaft 26 is limit axial displacement of the tension member 48 in the direction of the intermediate part 58.

A locking device designated in its entirety 84 is provided on the side of the work spindle 12 opposite the screw 40. The locking device 84 comprises an annular disc 86 held on the intermediate part 58 and arranged around it. The annular disc 86 extends radially in a plane which is perpendicular to the axis of rotation 18 as fat as an inside surface 88 of an annular space 90 surrounding the intermediate part 58. The inside surface 88 of the annular space 90 is formed by the housing 28 and comprises recesses 92 in which lugs 94 protruding radially from the annular disc 86 engage and thereby hold the annular disc 86 in a non-rotatable manner in the housing 28. These recesses 92 extend parallel to the axis of rotation 18 so the annular disc 86 is movable together with the intermediate part 58 upon displacement of the tension member 48. As is apparent, in particular, from FIG. 2, depressions 96 are pressed into this annular disc 86 opposite the end face 82 of the hollow shaft 26. These depressions 96 are designed so as to be engageable with claws 98 arranged on the end face 82 of the hollow shaft 26. Hence the claws 98 arranged on the end face 82 of the hollow shaft 26 form one coupling element while the other coupling element is formed by the annular disc 86 with its depressions 96.

The depressions 96 preferably have abutting surfaces 100 which extend at an incline, viewed in the direction of rotation.

By means of these abutting surfaces 100 it is possible for the two coupling elements to be disengaged in spite of engagement of depressions 96 and claws 98 if, for example, the drive 25 is inadvertently switched on. However, in order to achieve this, one of the coupling elements must be able to evade the effect exerted by the force of a spring. To this end, two different ways of resiliently arranging the depressions 96 are conceivable, as shown in FIG. 2. The annular disc 86 is preferably made of a resilient material, for example, spring steel and comprises one slot 102 located radially inwardly with respect to the recess 96 and one radially outwardly located slot 104 which extend parallel to an inner contour or an outer contour of the annular disc 86, preferably on a circular path. Hence the effect of the spring force of a spring region 106 arranged between the slots 102 and 104 and carrying the recess 96 can be fixed by the length of the arcs of these slots 102 and 104.

One possibility of defining the spring region 106 is illustrated on the left-hand side in FIG. 2. Here the spring region 106 passes over on both sides into the annular disc 86, i.e., the spring region 106 is separated from the annular disc 86 merely by the inner slot 102 and the outer slot 104. A second possibility is illustrated on the right-hand side in FIG. 2. Here the two slots 102' and 104' are joined on one side of the depression 96 by a transverse slot 108' so the spring region 106' passes over into the annular disc 86 on one side only and free spring motion is thereby possible with an end defined by the transverse slot 108'.

Therefore, both possibilities enable the depressions 96 to evade the claws 98 in the direction away from these and against the force of the spring regions 106 and 106' when the claws 98 press against the abutting surfaces 100.

The first embodiment, illustrated in FIG. 1, operates as follows:

In the initial stage, illustrated on the left-hand side in FIG. 1, the actuating lever 70 is in the drawn position in which the eccentric 68 does not act upon the cam 66 of the intermediate part 58. The intermediate part 58 is acted upon in the direction of the eccentric 68 by the spring 78 and so the roller bearing 62 and hence also the end face 60 of the tension member 48 are not acted upon by the intermediate part 58. In this position, the end face is at a short distance from the securing ring 80 and so the tension member is freely movable in the direction of the axis of rotation towards the intermediate part 58 and is merely subjected to the effect of the force of spring 50. The tension member 48 thereby clamps the screw 40 inserted therein which acts through its head 42 upon the clamping flange 34 of the intermediate sleeve 36 which, in turn, clamps the grinding disc 32 between itself and the counter flange 30.

In this state, the annular disc 86 held on the intermediate part 58 is in its position in which it is moved away from the end face 82 and so the depressions 96 do not engage with the claws 98. Hence the work spindle 12 and, in particular, the hollow shaft 26 is freely rotatable.

In the position illustrated on the right-hand side in FIG. 1, the actuating lever 70 is in the position indicated by dashed lines and so the eccentric 68 acts upon the cam 66 and thereby moves the intermediate part 58 in the direction of the counter flange 30. Through the roller bearing 62, the intermediate part 58 also presses the tension member 48 in the direction of the counter flange 30 against the force of the spring 50 and so the screw 40 inserted in the tension member 48 moves with its head 42 away from the clamping flange 34. Hence the grinding disc 32 is no longer firmly clamped between the clamping flange 34 and the counter flange 30. The head 42 can then be easily turned by hand and so the grinding disc 32 can be exchanged by screwing out the screw 40 and taking out the clamping sleeve 36.

In this position, the annular disc 86 is also simultaneously pushed by the intermediate part 58 in the direction towards the end face 82 of the hollow shaft 26 and so the depressions 96 engage the claws 98. Therefore, by virtue of the non-rotatable mounting of the annular disc 86 with its lugs 94 in the recesses 92 in the housing 28, the hollow shaft 26, too, and hence the entire work spindle 12 is non-rotatably fixed relative to the housing 28.

If, in this position, the motor is inadvertently switched on and, consequently, causes the hollow shaft 26 to rotate, the depressions 96 have on account of their arrangement in the spring regions 106 and 106', respectively, the possibility of evading the claws 98 in the direction away from these and, therefore, both the locking device 84 and the drive 25 are protected against damage.

A second embodiment, illustrated in FIGS. 3 and 4, bears the same reference numerals insofar as the same parts are used as in the first embodiment and, therefore, reference is made in this connection to the above description.

In contrast with the first embodiment, the housing 28 comprises a partly cylindrical section 110 with opposite flat surfaces which surrounds the intermediate part 58 and over which a bushing 112 engages. The bushing 112 rests with its circumference 114 against outer sides 116 of the section 110 and is held in a non-rotatable manner on the section 110 by the two flat circumferential surfaces 118 resting against the flat surfaces of the partly cylindrical section 110. The bushing 112 is displaceable in its entirety parallel to the axis of rotation 18 of the work spindle 12.

A bottom part 120 of the bushing 112 extends from the circumference 114 to a central opening 122 which surrounds the intermediate part 58. The bottom part 120 comprises recesses 124 on opposite sides for engagement with the claws 98. With respect to their function, the recesses 124 correspond to the depressions 96 of the first embodiment. In contrast with the first embodiment, the bushing 112 forming one coupling element of the locking device 84 is not rigidly mounted on the intermediate part 58 but is movable relative to the latter in the direction of the axis of rotation away from the end face 82. For this purpose, the intermediate part 58 is provided on the side of the opening 112 facing the hollow shaft with a stop ring 126 against which the bottom part 120 of the bushing 112 is pressed by means of a Belleville washer 128 which is supported on a shoulder 130 of the intermediate part 58 opposite the stop ring 126.

As illustrated on the left-hand side in FIG. 3, the stop ring 126 is arranged such that when the cam 66 is not acted upon by the eccentric 68, the intermediate part 58 holds the bottom part 120 so far above the claws 98 that these do not engage the recesses 124.

In contrast, as shown on the right-hand side in FIG. 3, the claws 98 fully engage the recesses 124 of the bottom part 120 when the cam 66 is acted upon the eccentric 68 in order to hold the screw 40 in its releasable position. In this embodiment, the claws 98 having inclined abutting surfaces 132 and, as shown in FIG. 5, these are, therefore, able to cooperate with the side rims of the recesses 124 and thereby push the bushing 112 away from the claws 98 in the direction of the axis of rotation 18 against the force of the Belleville washer 128. Therefore, in this embodiment, too, damage to the locking device 84 and the drive motor may be prevented when the drive motor is switched on.

In a third embodiment, illustrated in FIGS. 6 and 7, insofar as the same parts are present, these bear the same reference numerals as in the first embodiment. Therefore, reference is made to the description of the first embodiment for an explanation of these.

Similarly to the first embodiment, in the third embodiment, illustrated in FIGS. 6 and 7, an annular disc 134 is arranged around the intermediate part 58 as coupling element. This annular disc 134 surrounds three sections 136 of the housing 28 which are arranged as segments of a circle at the same angular spacing around the intermediate part 58. Projections 138 of the annular disc 134 protrude into spaces located between these sections 136. The intermediate part 58 arranged within the sections 136 has flat surfaces 140 which differ from the cylindrical shape so the projections 138 may press forward as far as the flat surfaces 140. The flat surfaces 140 extend in the direction of the axis of rotation 18, on the one hand, as far as the roller bearing 62 and, on the other hand, as far as shoulders 142 above which the intermediate part 58 is of circular cylindrical shape.

A spring element 144 with lugs 146 is supported at these shoulders 142. The spring element 144 extends radially downwardly at an incline towards the annular disc 134 and acts upon it in an outer region thereof. In order to hold the annular disc 134 in a position in which its depressions 96 do not engage the claws 98 when the intermediate part 58 is in the position drawn on the left-hand side in FIG. 6 in which the cam 66 is not acted upon, a spring ring 148 is arranged in the housing 28 so as to surround the end face 82 of the hollow shaft 26 on its outer side. The spring ring 148 is supported at its side facing the bearing 16 on an annular flange 150 fixed on the housing and the annular disc 134 rests with its outer circumferential region on the spring ring 148. Hence the annular disc 134 is clamped between the spring ring 148 and the spring element 144 and in the state of the intermediate part 58 in which it is not acted upon, illustrated on the left-hand side in FIG. 6, the spring element 144 is not compressed and so the spring ring 148 holds the annular disc 134 and its depressions 96 out of engagement with the claws 98. It is also possible for claws which are similar in shape to that of the depressions 96 to be provided on the annular disc 134 instead of the depressions 96.

However, once—as shown on the right-hand side of FIG. 6—the cam 66 is acted upon the hence and intermediate part 58 is displaced in the direction of the tension member 48 in order to act upon it, the intermediate part 58 presses by means of the shoulders 142 on the spring element 144 which, in turn, acts upon the annular disc 134 and owing to the fact that the constant of elasticity of the spring element 144 is greater than that of the spring ring 148, the spring element 144 also compresses the spring ring 148 so the depressions 96 now engage the claws 98. In this embodiment too, depressions 96 may, however, evade the claws 98 in the direction away from the latter against the action of the spring element 144.

In a fourth embodiment, illustrated in FIG. 8, an annular disc 86 corresponding to the first embodiment is, for example, used. The remaining parts, insofar as they are identical with those of the first embodiment, also bear the same reference numerals.

In contrast with the first embodiment, the annular disc 86 is not provided with depressions 96 but with a friction disc 152 which is located opposite a friction disc 154 arranged on the end face 82 of the hollow shaft 26. Therefore, when the intermediate part 58 is in the position in which it is pushed towards the tension member 48, the two friction discs 152 and 154 rest against each other and fix the hollow shaft 26 relative to the housing 28. In this embodiment, resilient evasion may be dispensed with but it is advantageous for the friction discs, in the state in which they rest against each other as shown on the right-hand side in FIG. 8, to be held in engagement with each other by elastic elements. If the annular disc 86 is made of an elastic material an additional spring element may be dispensed with.

In a fifth embodiment, illustrated in FIGS. 9, 10 and 11, the locking device 156 comprises a bolt 160 which is mounted on the housing 28 and is advanceable in the radial direction towards the hollow shaft 26 by means of a spring 158. With a conical head 162, the bolt 160 can engage a conical recess 164 provided in an outer side of the hollow shaft 26 in order to fix the hollow shaft 26 and hence the work spindle 12, as shown in FIG. 10.

A centrifugal adjusting mechanism 166 is provided to prevent the bolt 160 from engaging the recess 164 with its head 162 when the work spindle 12 is rotating. The centrifugal adjusting mechanism 166 comprises an annular clip 170 arranged in an annular groove 168 of the tension member 48 and carrying a pin 172 in the region of one end. This pin 172 protrudes into a bore 174 in the hollow shaft 26 which is arranged coaxially with the recess 164 and merges into it in the radial direction. The pin 172 is of such dimensions that a front surface 176 thereof lies in the same geometrical plane as the outer circumferential surface 178 when due to the effect of the centrifugal force during rotation of the work spindle 12 the pin is fully inserted in the bore 174 and the recess 164 and has urged the bolt 160 out of the recess 164.

Owing to the conically shaped head 162 of the bolt 160, once the drive motor of this angle grinder is started, the bolt 160 is pushed out of the recess 164 against the force of the spring 158 and then slides along the outer circumferential surface 178 of the hollow shaft 26 until the recess 164 is in coaxial alignment with the bolt 160 again. During this rotation, however, the pin 172 which is drawn inwardly on account of the resilient clip 170 while the work spindle is stationary will have been caused by the centrifugal force to enter the bore 174 and the recess 164 and so its front surface 176 will lie in the same geometrical plane as the outer circumferential surface 178 and, consequently, the bolt 160 will be unable to enter the recess 164 with its head 162 and fix the hollow shaft 26 stationarily on the housing.

In order to insert the tension member 48 with the spring clip 170 held in the annular groove 168 and the pin 172, the hollow shaft 26 is provided on its inside surface with a groove 180 which extends from the bore 174 to the top end of the hollow shaft 26 and guides the pin 172 to the bore 174 during insertion.

The annular clip 170 must be made of relatively unstable material in order for the pin 172 to be able to move in the radial direction. FIG. 11 shows a clip 170' as a further variant which owing to its oval shape allows the pin 172 to move in the radial direction.

In a sixth embodiment, illustrated in FIG. 12, as in the above-described embodiment, the bolt 160 engages with its conical head 162 the likewise conically shaped recess 164 in the radial direction in relation to the axis of rotation 18 when the hollow shaft 26 is stationary, the bolt 160 being acted upon in this direction by the spring 158 which is supported on the housing 28.

In contrast with the above-described embodiment, however, an electromagnet 182 arranged on the side opposite the head 162 is provided to disengage the head 162 from the recess 164, the armature 184 of the electromagnet 182 being fixedly connected to the bolt 160. This electromagnet 182 is connected in parallel with the drive motor and so once the drive motor is switched on the electromagnet 182 pulls the armature 184 radially outwardly in relation to the axis of rotation 18 and hence disengages the head 162 from the recess 164. In this embodiment, the bolt 160 with the electromagnet 182 arranged behind it is preferably located in the region of a side of the gear housing which faces the drive motor and, expediently, the electromagnet 182 is arranged in the motor housing and is coupled with the bolt 160 by means of a connection piece 186. If the portable tool is driven by a pneumatic motor, the bolt 160 can be moved by a pneumatic lifting cylinder.

The present disclosure relates to the subject matter disclosed in German application No. P 37 41 484.4 of Dec. 8, 1987, the entire specification of which is incorporated herein by reference.

What is claimed is:

1. Portable machine tool, in particular an angle grinder, comprising:

a drive, a work spindle having a tool clamping means, a securing device which is operable from outside an apparatus housing and by means of which the tool clamping means is transferable from a manually releasable position to a manually unreleasable position in which the tool is clamped and vice versa, a locking device for non-rotatably fixing said work spindle in a non-rotatable manner on said apparatus housing, and means for coupling said tool securing device and said locking device for fixing said work spindle in said non-rotatable manner when said securing device is operated for transferring said tool clamping means from said manually unreleasable position to said manually releasable position and for releasing said work spindle when said tool clamping means is operated for transferring said tool clamping means from said manually releasable position to said manually unreleasable position.

2. Portable machine tool as defined in claim 1, characterized in that said locking device (84, 156) comprises two coupling elements (98, 96, 124, 152, 162, 164) which upon actuation can be brought into operative engagement and which can be released from operative engagement out of this position against the force of an elastic element (106, 128, 144).

3. Portable machine tool as defined in claim 2, characterized in that said locking device (84) comprises coupling elements (152, 154) which form a friction coupling.

4. Portable machine tool as defined in claim 2, characterized in that one coupling element of said locking device (84, 156) comprises at least one claw (98, 162) and the respective other coupling element comprises a counterpart (96, 124, 164) which can be brought into engagement with said claw (98, 162).

5. Portable machine tool as defined in claim 4, characterized in that said claw (98, 162) and/or said counterpart (96, 124, 164) comprise in their regions which come to rest against one another and extend transversely to a direction of rotation abutting surfaces (100, 132) which are oriented at an incline to the direction of rotation, and in that said claw (98, 162) and said counterpart (96, 124, 164) can be disengaged by sliding on said abutting surfaces (100, 132) against the force of said elastic element (106, 128, 144, 158).

6. Portable machine tool as defined in claim 4, characterized in that said claw (98) and said counterpart (96, 124) can be brought into engagement with one another by an adjusting motion in the axial direction (18) in relation to said work spindle (12).

7. Portable machine tool as defined in claim 1, characterized in that said locking device (84, 156) is arranged at an end of said work spindle (12) which is located opposite said tool clamping means (30, 34).

8. Portable machine tool as defined in claim 1, characterized in that said locking device (84) is actuatable by operating said securing device (44).

9. Portable machine tool as defined in claim 8, characterized in that said locking device (84) is actuatable by a shifting device (56) of said securing device (44).

10. Portable machine tool as defined in claim 9, characterized in that said shifting device (56) comprises a first coupling element (96, 124, 152) which is displaceable in the axial direction (18) of said work spindle (12) towards the latter and is held in a non-rotatable manner in said apparatus housing (28), and said work spindle comprises a second coupling element (98, 154).

11. Portable machine tool as defined in claim 10, characterized in that said first coupling element (96, 124, 152) is held on an intermediate part (58) of said shifting device (56).

12. Portable machine tool as defined in claim 10, characterized in that at least one of said coupling elements (98, 96, 124, 152, 154) is elastically connected in the axial direction (18) to said shifting device (56) or to said work spindle (12).

13. Portable machine tool as defined in claim 1, characterized in that one of said coupling elements (96) is arranged on an elastic carrier (86).

* * * * *